US005627128A

United States Patent [19]

Bowman et al.

[11] Patent Number: 5,627,128

[45] Date of Patent: May 6, 1997

[54] THERMAL DYE TRANSFER SYSTEM WITH LOW TG POLYMERIC RECEIVER MIXTURE

[75] Inventors: Wayne A. Bowman, Walworth; Daniel J. Harrison, Pittsford; Karen M. Kosydar, Penfield; Teh-Ming Kung; Kristine B. Lawrence, both of Rochester; William H. Simpson, Pittsford, all of N.Y.

[73] Assignee: Eastman Kodak Company, Rochester, N.Y.

[21] Appl. No.: 609,817

[22] Filed: Mar. 1, 1996

[51] Int. Cl.[6] ..... B41M 5/035; B41M 5/38

[52] U.S. Cl. ..... 503/227; 428/195; 428/500; 428/913; 428/914

[58] Field of Search ..... 8/471; 428/195, 428/500, 913, 914; 503/227

[56] References Cited

U.S. PATENT DOCUMENTS

| | | | |
|---|---|---|---|
| 4,880,769 | 11/1989 | Dix et al. | 503/227 |
| 5,030,612 | 7/1991 | Uytterhoeven et al. | 503/227 |
| 5,324,705 | 6/1994 | Ito | 503/227 |
| 5,523,274 | 6/1996 | Shuttleworth et al. | 503/227 |
| 5,534,479 | 7/1996 | Shuttleworth et al. | 503/227 |

*Primary Examiner*—B. Hamilton Hess
*Attorney, Agent, or Firm*—Harold E. Cole

[57] ABSTRACT

A thermal dye transfer assemblage comprising:

(a) a dye-donor dement comprising a support having thereon a dye layer comprising a dye dispersed in a polymeric binder, the dye being a deprotonated cationic dye which is capable of being reprotonated to a cationic dye having a N—H group which is part of a conjugated system, and (b) a dye-receiving element comprising a support having thereon a polymeric dye image-receiving layer, the dye-receiving element being in a superposed relationship with the dye-donor element so that the dye layer is in contact with the polymeric dye image-receiving layer, the polymeric dye image-receiving layer comprising a mixture of an organic polymeric or oligomeric acid which is capable of reprotonating the deprotonated cationic dye and a polymer having a Tg of less than about 19° C. and having no or only slight acidity.

8 Claims, No Drawings

THERMAL DYE TRANSFER SYSTEM WITH LOW TG POLYMERIC RECEIVER MIXTURE

This invention relates to a thermal dye transfer receiver element of a thermal dye transfer assemblage and, more particularly, to a polymeric dye image-receiving layer containing a mixture of materials capable of reprotonating a deprotonated cationic dye transferred to the receiver from a suitable donor.

In recent years, thermal transfer systems have been developed to obtain prints from pictures which have been generated electronically from a color video camera. According to one way of obtaining such prints, an electronic picture is first subjected to color separation by color filters. The respective color-separated images are then convened into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dyes for thermal dye transfer imaging should have bright hue, good solubility in coating solvents, good transfer efficiency and good light stability. A dye receiver polymer should have good affinity for the dye and provide a stable (to heat and light) environment for the dye after transfer. In particular, the transferred dye image should be resistant to damage caused by handling, or contact with chemicals or other surfaces such as the back of other thermal prints, adhesive tape, and plastic folders such as poly(vinyl chloride), generally referred to as "retransfer".

Commonly-used dyes are nonionic in character because of the easy thermal transfer achievable with this type of compound. The dye-receiver layer usually comprises an organic polymer with polar groups to act as a mordant for the dyes transferred to it. A disadvantage of such a system is that since the dyes are designed to be mobile within the receiver polymer matrix, the prints generated can suffer from dye migration over time.

A number of attempts have been made to overcome the dye migration problem which usually involves creating some kind of bond between the transferred dye and the polymer of the dye image-receiving layer. One such approach involves the transfer of a cationic dye to an anionic dye-receiving layer, thereby forming an electrostatic bond between the two. However, this technique involves the transfer of a cationic species which, in general, is less efficient than the transfer of a nonionic species.

U.S. Pat. No. 4,880,769 describes the thermal transfer of a neutral, deprotonated form of a cationic dye to a receiver element. The receiver element is described as being a coated paper, in particular organic or inorganic materials having an "acid-modified coating". The inorganic materials described are materials such as an acidic clay-coated paper. The organic materials described are "acid-modified polyacrylonitrile, condensation products based on phenol/formaldehyde, certain salicylic acid derivatives and acid-modified polyesters, the latter being preferred." However, the way in which the "acid-modified polyester" is obtained is that an image is transferred to a polyester-coated paper, and then the paper is treated with acidic vapor to reprotonate the dye on the paper.

There is a problem with using this technique of treating polymeric-coated papers with acidic vapors in that this additional step is corrosive to the equipment employed and is a safety hazard to operators. There is also a problem with such a post treatment step to provide an acidic counterion for the cationic dye in that the dye/counterion complex is mobile, and can be retransferred to unwanted surfaces.

U.S. Pat. No. 5,324,705 relates to the use of acidic resin receivers such as vinylidene chloride/acrylonitrile copolymers for use with modified cationic dyes where the counterion has been exchanged for a more oleophilic anion. There is no disclosure in this patent that these receivers can be used with a deprotonated cationic dye which is capable of being reprotonated to a cationic dye. In addition, the Tg of this receiver material is such that dye stratification is observed at the receiver surface after printing.

U.S. Pat. No. 5,030,612 discloses the thermal transfer of sublimable basic dye precursors into acid-containing acrylate copolymer receivers having a Tg between 30° and 90° C. Basic dye precursors are leuco type dyes and the acid groups in the receiver serve as color developing sites. Again there is no disclosure in this patent that these receivers can be used with a deprotonated cationic dye which is capable of being reprotonated to a cationic dye.

U.S. Pat. No. 5,534,479 relates to a thermal dye transfer assemblage wherein the dye image-receiving layer contains an organic acid moiety as part of the polymer chain. U.S. Pat. No. 5,523,274 relates to a thermal dye transfer assemblage wherein the dye image-receiving layer contains an organic acid moiety as part of the polymer chain and which has a Tg of less than about 25° C. While these assemblages have been found to be useful, there is a problem with them in that dye tends to stratify at the receiving layer surface, leading to slower dye reprotonation rates. Further, the dye image-receiving layer mixture of this invention is not disclosed.

It is an object of this invention to provide a thermal dye transfer system employing a dye-receiver having an acidic dye image-receiving layer without having to use a post-treatment fuming step with acidic vapors. It is another object of this invention to provide a thermal dye transfer system employing a dye-receiver which will result in an increase in the rate of dye reprotonation (% of dye conversion). It is still another object to reduce dye stratification at the receiver surface after printing.

These and other objects are achieved in accordance with this invention which relates to a thermal dye transfer assemblage comprising:

(a) a dye-donor element comprising a support having thereon a dye layer comprising a dye dispersed in a polymeric binder, the dye being a deprotonated cationic dye which is capable of being reprotonated to a cationic dye having a N—H group which is part of a conjugated system, and (b) a dye-receiving element comprising a support having thereon a polymeric dye image-receiving layer, the dye-receiving element being in a superposed relationship with the dye-donor element so that the dye layer is in contact with the polymeric dye image-receiving layer, the polymeric dye image-receiving layer comprising a mixture of an organic polymeric or oligomeric acid which is capable of reprotonating the deprotonated cationic dye and a polymer having a Tg of less than about 19° C. and having no or only slight acidity.

It was found that a dye-receiving layer comprising a mixture of a polymer with a Tg of less than about 19° C. and having no or only slight acidity and an organic polymeric or oligomeric acid capable of reprotonating a deprotonated cationic dye results in an increase in the rate of dye reprotonation (% of dye conversion). Also, dye stratification at the receiver surface after printing was reduced with the of receiver layer of the invention.

The polymer having a Tg of less than about 19° C. employed in the invention may contain groups which are slightly acidic to improve water dispersibility. However, these acid groups are generally insufficient to protonate the dye.

In a preferred embodiment of the invention, the deprotonated cationic dye employed which is capable of being reprotonated to a cationic dye having a N—H group which is part of a conjugated system has the following equilibrium structure:

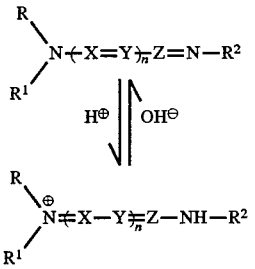

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or naphthyl or a substituted or unsubstituted alkyl group from about 1 to about 10 carbon atoms; and n is 0 to 11.

Cationic dyes according to the above formula are disclosed in U.S. Pat. Nos. 4,880,769 and 4,137,042, and in K. Venkataraman ed., *The Chemistry of Synthetic Dyes*, Vol. IV, p. 161, Academic Press, 1971, the disclosures of which are hereby incorporated by reference.

The following dyes may be used in accordance with the invention, which also have listed the absorption maxima of the deprotonated and protonated species, with the values for the latter shown in parentheses:

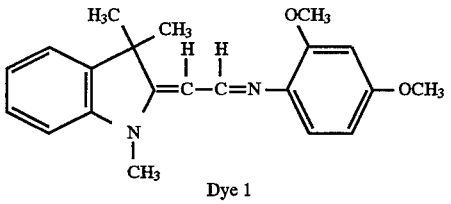

Dye 1
λmax 379 nm (405 nm)
yellow (yellow)

-continued

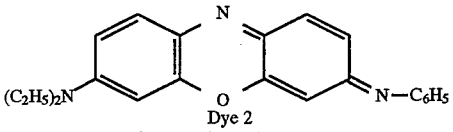

Dye 2
λmax 556 nm (641 nm)
magenta (cyan)

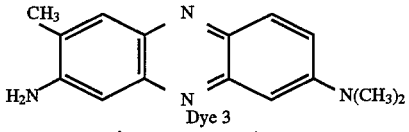

Dye 3
λmax 459 nm (536 nm)
yellow (magenta)

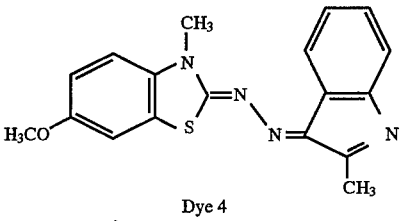

Dye 4
λmax 459 nm (522 nm)
yellow (magenta)

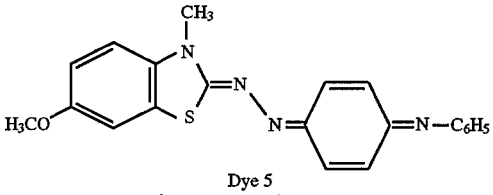

Dye 5
λmax 503 nm (621 nm)
red (blue)

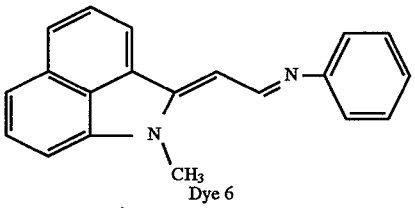

Dye 6
λmax 479 nm (513 nm)
yellow (megenta

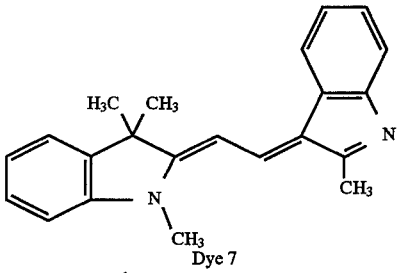

Dye 7
λmax 485 nm (495)
yellow (yellow)

The above dyes may be employed at a concentration of from about 0.05 g/m² to about 5 g/m².

The polymeric or oligomeric acid source used in the invention can be any polymer or oligomer which contains an acid group such as a sulfonic acid, phosphoric acid or carboxylic acid which is capable of protonating the dye. It may be used in an amount of from about 0.05 g/m² to about 20 g/m².

Following are examples of polymeric or oligomeric acid sources that can be used for protonating the dyes in accordance with the invention,

| | |
|---|---|
| A-1 | Polymer AQ29D Polyester ionomer, mw = 20,000 (Eastman Chemical Co.) having sodium sulfonate groups which are converted to sulfonic acid groups |
| A-2 | poly(2-acrylamido-2-methylpropane sulfonic acid) |
| A-3 | poly(vinylsulfonic acid) |
| A-4 | poly(ethylene-co-vinylsulfuric acid) 61:39 wt (vinyl sulfate) |
| A-5: | poly[isophthalate-co-5-sulfoisophthalic (90:10 molar ratio)-diethylene glycol (100 molar ratio), mw = 4,765 (polyester oligomer) |

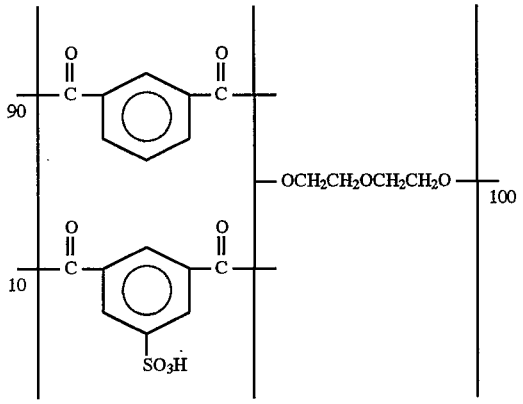

Any type of polymer may be employed in the receiver of the invention, e.g., condensation polymers such as polyesters, polyurethanes, polycarbonates, etc.; addition polymers such as polystyrenes, vinyl polymers, acrylic polymers, etc.; block copolymers containing large segments of more than one type of polymer covalently linked together, provided such polymeric material has the low Tg as described above. In a preferred embodiment of the invention, the dye image-receiving layer comprises an acrylic polymer, a styrene polymer or a vinyl polymer. These polymers may be employed at a concentration of from about 0.05 g/m$^2$ to about 20 g/m$^2$.

Following are examples of polymers that may be used in the invention:

Polymer P-1: poly(butyl acrylate-co-allyl methacrylate) 98:2 wt core/poly(glycidyl methacrylate) 10 wt shell, (Tg=–40° C.)

Polymer P-2: poly(butyl acrylate-co-allyl methacrylate) 98:2 wt core/poly(ethyl methacrylate) 30 wt shell, (Tg=–41° C.)

Polymer P-3: poly(butyl acrylate-co-allyl methacrylate) 98:2 wt core/poly(2-hydroxypropyl methacrylate) 10 wt shell, (Tg=–40° C.)

Polymer P-4: poly(butyl acrylate-co-ethyleneglycol dimethacrylate) 98:2 wt core/poly(glycidyl methacrylate 10 wt shell, Tg=–42° C.)

Polymer P-5: poly(butyl acrylate-co-allyl methacrylate-co-glycidyl methacrylate) 89:2:9 wt, (Tg=–34° C.)

Polymer P-6: poly(butyl acrylate-co-ethyleneglycol dimethacrylate-co-glycidyl methacrylate) 89:2:9 wt (Tg=–28° C.)

Polymer P-7: poly(butyl methacrylate-co-butyl acrylate-co-allyl methacrylate) 49:49:2 wt core/poly(glycidyl methacrylate) 10 wt shell, (Tg=–18° C.)

Polymer P-8: poly(methyl methacrylate-co-butyl acrylate-co-2-hydroxyethyl methacrylate-co-2-sulfoethyl methacrylate sodium salt) 30:50:10:10 wt, (Tg=–3° C.)

Polymer P-9: poly(methyl methacrylate-co-butyl acrylate-co-2-hydroxyethyl methacrylate-co-styrenesulfonic acid sodium salt) 40:40: 10:10 wt, (Tg=0° C.)

Polymer P-10: poly(methyl methacrylate-co-butyl acrylate-co-2-sulfoethyl methacrylate sodium salt-co-ethyleneglycol dimethacrylate) 44:44:10:2 wt, (Tg=14° C.)

Polymer P-11: poly(butyl acrylate-co-Zonyl TM®-co-2-acrylamido-2-methyl-propanesulfonic acid sodium salt) 50:45:5 wt (Tg=–39° C.) (Zonyl TM® is a monomer from the DuPont Company)

Polymer P-12:XU31066.50 (experimental polymer based on a styrene butadiene copolymer from Dow Chemical Company) (Tg=–31° C.)

Polymer P-13: AC540® nonionic emulsion (Allied Signal Co.) (Tg=–55° C.)

The polymer in the dye image-receiving layer may be present in any amount which is effective for its intended purpose. In general, good results have been obtained at a concentration of from about 0.5 to about 20 g/m$^2$. The polymers may be coated from organic solvents or water, if desired.

The support for the dye-receiving element employed in the invention may be transparent or reflective, and may comprise a polymeric, a synthetic paper, or a cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Resistance to sticking during thermal printing may be enhanced by the addition of release agents to the dye-receiving layer or to an overcoat layer, such as silicone-based compounds, as is conventional in the art.

Dye-donor elements that are used with the dye-receiving element of the invention conventionally comprise a support having thereon a dye layer containing the dyes as described above dispersed in a polymeric binder such as a cellulose derivative, e.g., cellulose acetate hydrogen phthalate, cellulose acetate, cellulose acetate propionate, cellulose acetate butyrate, cellulose triacetate, or any of the materials described in U.S. Pat. No. 4,700,207; or a poly(vinyl acetal) such as poly(vinyl alcohol-co-butyral). The binder may be used at a coverage of from about 0.1 to about 5 g/m$^2$.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of deprotonated dyes, as described above, capable of generating a cyan, magenta and yellow dye and the dye transfer steps are sequentially performed for each color to obtain a three-color dye transfer image. Of course, when the process is only performed for a single color, then a monochrome dye transfer image is obtained.

Thermal print heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers described in, for example, GB No. 2,083,726A.

When a three-color image is to be obtained, the assemblage described above is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner. After thermal dye transfer, the dye image-receiving layer contains a thermally-transferred dye image.

The following examples are provided to further illustrate the invention.

EXAMPLE 1

Preparation of Dye Donor Elements

Individual dye-donor elements were prepared by coating on a 6 μm poly(ethylene terephthalate) support:

1) a subbing layer of Tyzor TBT®, a titanium tetrabutoxide, (DuPont Company) (0.16 g/m$^2$) coated from 1-butanol/propyl acetate (15/85); and
2) a dye layer containing dyes 1 or 2 described above and FC-431®, a fluorocarbon surfactant (3M Company) (0.011 g/m$^2$) in a poly(vinyl butyral) binder, Butvar 76® (Monsanto Chemical Co.) coated from a tetrahydrofuran and cyclopentanone mixture(95/5). Details of dye and binder laydowns are shown below in Table 1.

On the back side of the dye-donor element were coated:

1) a subbing layer of Tyzor TBT®, a titanium tetrabutoxide, (DuPont Company) (0.16 g/m$^2$) coated from 1-butanol/propyl acetate (15/85); and
2) a slipping layer of poly(vinyl acetal) (Sekisui Kagaku KK), (0.38 g/m$^2$), a Candelilla wax dispersion (7% in methanol) (0.022 g/m$^2$), PS513, an amino-terminated polydimethylsiloxane (Huels) (0.011 g/m$^2$) and p-toluenesulfonic acid (0.003 g/m$^2$) coated from 3-pentanone/distilled water (98/2) solvent mixture.

TABLE 1

| Dye Donor Element | Dye | Dye Laydown g/m$^2$ | Butvar ® 76 Binder Laydown g/m$^2$ |
|---|---|---|---|
| 1 | 1 | 0.28 | 0.37 |
| 2 | 2 | 0.15 | 0.23 |

Control Receiver Elements C-1and C-2:

Control dye receiver elements were prepared by first extrusion-laminating a paper core with a 38 μm thick micro voided composite film (OPPalyte® 350TW, Mobil Chemical Co.) as disclosed in U.S. Pat. No. 5,244,861. The composite film side of the resulting laminate was then coated with the following layers in the order recited:

1) a subbing layer of Prosil® 221, an aminopropyltriethoxysilane, (0.05 g/m$^2$) and Prosil® 2210, an amino-functional epoxysilane, (0.05 g/m$^2$) (PCR, Inc.) coated from 3A alcohol; and
2) a dye-receiving layer of 6.73 g/m$^2$ of A-1 or A-2 acid and a fluorocarbon surfactant, Fluorad FC-170C® (3M Corporation) (0.022 g/m$^2$) coated from distilled water (see Table 2 below).

Receiver Elements of the Invention 1 and 2

These were prepared the same as Control Receiver Elements 1 and 2 except the dye-receiving layer contained a mixture of either acid source A-1 or A-2 and P-1 polymer. The dry laydowns (g/m$^2$) for A-1 and A-2 were determined by matching meq/g of strong acid in the final coating, keeping the final dry laydown of the mixture constant at 6.73 g/m$^2$. The meq/g of strong acid and dry laydowns for A-1 and A-2 and dry laydown for P-1 were as follows:

TABLE 2

| Receiver Element | Acid Source | Acid Source, meq/gm ($SO_3H$) | Acid Source laydown (g/m$^2$) | P-1 Polymer (g/m$^2$) |
|---|---|---|---|---|
| 1 | A-1 | 0.391 | 2.69 | 4.04 |
| 2 | A-2 | 4.83 | 0.22 | 6.51 |
| C-1 | A-1 | 0.391 | 6.73 | — |
| C-2 | A-2 | 4.83 | 6.73 | — |

Receiver Elements 1 and 3–14 of the Invention and Control Receiver Elements C-3 through C-8

These were prepared the same as Receiver elements 1 and 2 except the dye-receiving layer was a mixture of 2.69 g/m$^2$ of the sulfonic acid of Polymer AQ29D (Eastman Chemical Company ) A-1 and 4.04 g/m$^2$ of polymers P-1 through P-13 described above and CP-1 through CP-6 described below. A summary for the combinations are as follows:

TABLE 3

| Receiver Element | Acid Source | Polymer | Polymer Tg °C. |
|---|---|---|---|
| 1 | A-1 | P-1 | −40° C. |
| 3 | A-1 | P-2 | −41° C. |
| 4 | A-1 | P-3 | −40° C. |
| 5 | A-1 | P-4 | −42° C. |
| 6 | A-1 | P-5 | −34° C. |
| 7 | A-1 | P-6 | −28° C. |
| 8 | A-1 | P-7 | −18° C. |
| 9 | A-1 | P-8 | −3° C. |
| 10 | A-1 | P-9 | 0° C. |
| 11 | A-1 | P-10 | 14° C. |
| 12 | A-1 | P-11 | −39° C. |
| 13 | A-1 | P-12 | −31° C. |
| 14 | A-1 | P-13 | −55° C. |
| C-3 | A-1 | CP-1 | 19° C. |
| C-4 | A-1 | CP-2 | 29° C. |
| C-5 | A-1 | CP-3 | 32° C. |
| C-6 | A-1 | CP-4 | 41° C. |
| C-7 | A-1 | CP-5 | 54° C. |
| C-8 | A-1 | CP-6 | 32° C. |

Control Polymers:

Polymer CP-1: poly(cyclohexyl acrylate-co-butyl methacrylate) 30:70 wt (Tg=19° C.)

Polymer CP-2: AQ29D polyester ionomer from Eastman Chemical Co. (Tg=29° C.)

Polymer CP-3: poly(butyl methacrylate) (Tg=32° C.)

Polymer CP-4: poly(styrene-co-butyl methacrylate-co-2-sulfoethyl methacrylate sodium salt 30:60:10 wt (Tg=41° C.)

Polymer CP-5: poly(methyl methacrylate-co-butyl methacrylate-co-2-sulfoethyl methacrylate sodium salt) 30:60:10 wt (Tg=54° C.)

Polymer CP-6: poly(butyl methacrylate-co-Zonyl TM®-co-2-acrylamido-2-methylpropane sulfonic acid sodium salt) 50:45:5 wt (Tg=32° C.) (Zonyl TM is a monomer from the DuPont Company)

Receiver Elements 15–20 of the Invention:

These were prepared the same as Receiver elements 1 and 2 except the dye-receiving layer was a mixture of acid sources A-2 through A-5 and P-1 or P-12 polymer. The dry laydowns for each component of the above mentioned combinations are as follows:

TABLE 4

| Receiver Element | Acid Source | Acid Source, meq/gm ($SO_3H$) | Acid Source laydown g/m$^2$ | Polymer | Polymer laydown, g/m$^2$ |
|---|---|---|---|---|---|
| 15 | A-2 | 4.83 | 0.22 | P-12 | 6.51 |
| 16 | A-3 | 5.71 | 0.18 | P-1 | 6.54 |
| 17 | A-3 | 5.71 | 0.18 | P-12 | 6.54 |
| 18 | A-4 | 3.13 | 0.33 | P-1 | 6.39 |
| 19 | A-4 | 3.13 | 0.33 | P-12 | 6.39 |
| 20 | A-5 | 0.396 | 2.69 | P-1 | 4.04 |

Preparation and Evaluation of Thermal Dye Transfer Images.

Eleven-step sensitometric thermal dye transfer images were prepared from the above dye-donor and dye-receiver elements. The dye side of the dye-donor element approximately 10 cm×15 cm in area was placed in contact with a receiving-layer side of a dye-receiving element of the same area. This assemblage was clamped to a stepper motor-driven, 60 mm diameter rubber roller. A thermal head (TDK No. 8I0625, thermostatted at 25° C.) was pressed with a force of 24.4 Newtons (2.5 kg) against the dye donor element side of the assemblage, pushing it against the rubber roller.

The imaging electronics were activated causing the donor-receiver assemblage to be drawn through the printing head/roller nip at 40.3 mm/s. Coincidentally, the resistive elements in the thermal print head were pulsed for 127.75 μs/pulse at 130.75 μs intervals during a 4.575 μs/dot printing cycle (including a 0.391 μs/dot cool down interval). A stepped image density was generated by incrementally increasing the number of pulses/dot from a minimum of 0 to a maximum of 32 pulses/dot. The voltage supplied to the thermal head was approximately 12.1 v resulting in an instantaneous peak power of 0.276 watts/dot and a maximum total energy of 1.24 mJ/dot. Print room humidity: 40%–45% RH.

For images containing a cyan dye (cyan or green channels), the rate of protonation is proportional to the rate of color change from the deprotonated dye form (magenta) to the protonated dye form (cyan). This color change can be monitored by measuring status A red (cyan) and green (magenta) densities at various time intervals and calculating the red/green ratio for each time interval. Complete protonation (conversion) of the cyan dye was equivalent to the red/green ratio after incubating prints at 50° C./50% RH for 3 hours and a % dye conversion can be calculated.

After printing, the dye-donor element was separated from the imaged receiving element and the Status A reflection red and green densities at step 10 in the stepped-image were measured for the green channel using a X-Rite 820 reflection densitometer alter 60 minutes at room temperature. The prints were then placed in a 50° C./50% RH oven for three hours and the red and green densities were reread. A red/green (R/G) ratio (minus the baseline) was calculated at step 10 of the green channel in each receiver at the above mentioned time intervals and the % dye conversion was calculated assuming the incubated R/G ratios were 100% dye conversion. The results are summarized in Table 5 below.

TABLE 5

| Receiver Element | Acid Source | R/G Ratio 1 Hour r.t.[1] | R/G Ratio 3 Hours Inc.[2] | % Dye Conversion 1 hr[3] |
|---|---|---|---|---|
| 1 | A-1 | 2.72 | 5.37 | 51%[4] |
| 2 | A-2 | 4.09 | 4.29 | 95% |
| C-1 | A-1 | 1.41 | 4.20 | 33% |
| C-2 | A-2 | 2.00 | 3.29 | 61% |

[1]calculated red/green ratio for green channel after one hour at room temperature

[2]incubated for three hours at 50° C./50% RH and then the red/green ratio for green channel was calculated

[3](R/G Ratio, 1 hr., room keep)/(R/G Ratio, 3 hrs., inc.) × 100 for green channel

[4]Print room humidity: 40%–45% RH.

The above data show that a receiving element containing a mixture of a polymer having a Tg less than 19° C. and having no or only slight acidity and an organic polymeric acid showed higher % conversion over the control receivers (C-1 and C-2) which contained only the organic polymeric acid.

EXAMPLE 2

Thermal dye transfers were prepared and evaluated as in Example 1, except that the print room humidity was 60%–70% RH and the results are summarized in Table 6 below.

TABLE 6

| Receiver Element | R/G Ratio 1 Hour r.t.[1] | R/G Ratio 3 Hours Inc.[2] | % Dye Conversion 1 hr[3] |
|---|---|---|---|
| 1 | 4.82 | 5.06 | 95%[4] |
| 3 | 4.63 | 4.63 | 100% |
| 4 | 4.27 | 4.67 | 92% |
| 5 | 4.63 | 4.97 | 93% |
| 6 | 4.64 | 5.03 | 92% |
| 7 | 4.49 | 5.03 | 89% |
| 8 | 3.08 | 5.25 | 59% |
| 9 | 3.00 | 4.21 | 71% |
| 10 | 2.54 | 4.25 | 60% |
| 11 | 2.40 | 3.91 | 61% |
| 12 | 4.08 | 4.76 | 86% |
| 13 | 3.44 | 4.30 | 80% |
| 14 | 3.44 | 4.47 | 77% |
| C-3 | 0.82 | 4.43 | 18% |
| C-4 | 0.89 | 5.48 | 16% |
| C-5 | 0.76 | 4.61 | 16% |
| C-6 | 0.79 | 2.71 | 29% |
| C-7 | 0.79 | 3.73 | 21% |
| C-8 | 1.21 | 4.38 | 28% |

[1–3]see Table 5 for explanation
[4]Print Room Humidity: 60%–70% RH

The above data show that a receiving element containing a mixture of a polymer having a Tg less than 19° C. and having no or only slight acidity and an organic polymeric acid showed higher % dye conversion over control receivers (C-3 through C-8) having a mixture of a polymer having a Tg greater than 19° C. and an organic polymeric acid.

EXAMPLE 3

Thermal dye transfers were prepared and evaluated as in Example 2 and the results are summarized in Table 7 below.

TABLE 7

| Receiver Element | R/G Ratio 1 Hour r.t.[1] | R/G Ratio 3 Hours Inc.[2] | % Dye Conversion 1 hr[3] |
|---|---|---|---|
| 15 | 3.13 | 3.42 | 91% |
| 16 | 4.24 | 4.53 | 94% |
| 17 | 2.98 | 3.38 | 88% |
| 18 | 3.75 | 4.45 | 84% |
| 19 | 3.13 | 3.36 | 93% |
| 20 | 4.94 | 5.50 | 90% |
| C-4 | 0.86 | 5.21 | 17% |

[1–3]see Table 5 for explanation

The above data show that a receiving element containing a mixture of a polymer or oligomer as an acid source and a polymer having a Tg less than 19° C. and having no or only slight acidity improves the % dye conversion as compared to a mixture of a polymer as an acid source and a polymer having a Tg greater than 19° C.

The invention has been described in detail with particular reference to preferred embodiments thereof, but it will be understood that variations and modifications can be effected within the spirit and scope of the invention.

What is claimed is:

1. A thermal dye transfer assemblage comprising:

(a) a dye-donor element comprising a support having thereon a dye layer comprising a dye dispersed in a polymeric binder, said dye being a deprotonated cationic dye which is capable of being reprotonated to a cationic dye having a N—H group which is part of a conjugated system, and (b) a dye-receiving element comprising a support having thereon a polymeric dye image-receiving layer, said dye-receiving element being in a superposed relationship with said dye-donor element so that said dye layer is in contact with said polymeric dye image-receiving layer, said polymeric dye image-receiving layer comprising a mixture of an organic polymeric or oligomeric acid which is capable of reprotonating said deprotonated cationic dye and a polymer having a Tg of less than about 19° C. and having no or only slight acidity.

2. The assemblage of claim 1 wherein said organic polymeric or oligomeric acid contains a sulfonic acid, phosphoric acid or carboxylic acid.

3. The assemblage of claim 1 wherein said polymer having a Tg of less than about 19° C. is an acrylic polymer, a styrene polymer or a vinyl polymer.

4. The assemblage of claim 1 wherein said deprotonated cationic dye has the following formula:

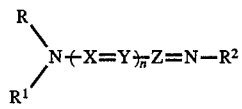

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or naphthyl or a substituted or unsubstituted alkyl group from about 1 to about 10 carbon atoms; and n is 0 to 11.

5. A process of forming a dye transfer image comprising imagewise-heating a dye-donor element comprising a support having thereon a dye layer comprising a dye dispersed in a polymeric binder, said dye being a deprotonated cationic dye which is capable of being reprotonated to a cationic dye having a N—H group which is part of a conjugated system, and imagewise transferring said dye to a dye-receiving element to form said dye transfer image, said dye-receiving element comprising a support having thereon a polymeric dye image-receiving layer, said polymeric dye image-receiving layer comprising a mixture of an organic polymeric or oligomeric acid which is capable of reprotonating said deprotonated cationic dye and a polymer having a Tg of less than about 19° C. and having no or only slight acidity.

6. The process of claim 5 wherein said organic polymeric or oligomeric acid contains a sulfonic acid, phosphoric acid or carboxylic acid.

7. The process of claim 5 wherein said polymer having a Tg of less than about 19° C. is an acrylic polymer, a styrene polymer or a vinyl polymer.

8. The process of claim 5 wherein said deprotonated cationic dye has the following formula:

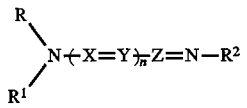

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or naphthyl or a substituted or unsubstituted alkyl group from about to about 10 carbon atoms; and n is 0 to 11.

* * * * *